US006475936B1

(12) United States Patent
Chiou

(10) Patent No.: US 6,475,936 B1
(45) Date of Patent: Nov. 5, 2002

(54) KNIFE-STAB-RESISTANT BALLISTIC ARTICLE

(75) Inventor: Minshon J. Chiou, Chesterfield, VA (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 160 days.

(21) Appl. No.: 09/592,200

(22) Filed: Jun. 13, 2000

(51) Int. Cl.[7] ..... B32B 5/26; D03D 13/00; F41H 1/02

(52) U.S. Cl. ..... 442/203; 442/239; 442/246; 442/247; 442/301; 442/381; 442/392; 442/414; 428/902; 428/911; 2/2.5

(58) Field of Search ..... 442/203, 239, 442/246, 381, 247, 392, 244, 301; 428/911, 902; 2/2.5

(56) References Cited

U.S. PATENT DOCUMENTS

| | | | | |
|---|---|---|---|---|
| 5,622,771 A | | 4/1997 | Chiou et al. | 428/219 |
| 6,003,424 A | | 12/1999 | Solares et al. | |
| 6,103,646 A | * | 8/2000 | Chiou | 442/244 |
| 6,133,169 A | * | 10/2000 | Chiou et al. | 442/234 |
| 6,154,880 A | * | 12/2000 | Bachner, Jr. | 2/2.5 |

FOREIGN PATENT DOCUMENTS

| | | | |
|---|---|---|---|
| EP | 0 670 466 | 3/1995 | F41H/5/04 |
| WO | WO 93/00564 | 1/1993 | F41H/5/04 |
| WO | WO 01 50898 A | 7/2001 | |

* cited by examiner

*Primary Examiner*—Elizabeth M. Cole
*Assistant Examiner*—Ula C. Ruddock

(57) ABSTRACT

A combination of layered structures is disclosed for protection from both knife stab and ballistic threats wherein the outer face is the knife stab strike face and includes layers of loosely woven fabrics and the inner face includes ballistic layers.

9 Claims, No Drawings

KNIFE-STAB-RESISTANT BALLISTIC ARTICLE

BACKGROUND OF THE INVENTION

1. Field of the Invention

It is well known that flexible garments made for protection from ballistic threats are not necessarily effective against stabbing by knives. The converse is also true—knife stab resistant articles are not necessarily effective against ballistic threats. This invention relates to articles that are flexible and provide protection from both knife stab threats and ballistic threats.

2. Discussion of the Prior Art

U.S. Pat. No. 5,622,771, issued Apr. 22, 1997, on the application of Chiou et al. discloses a penetration-resistant article made from tightly woven aramid yarns having particularly low linear density.

International Publication No. WO 93/00564, published Jan. 7, 1993, discloses ballistic structures using layers of fabric woven from high tenacity para-aramid yarn.

European Patent Application No. 670,466, published Sep. 6, 1995, describes a ballistic and stab-resistant system wherein the knife stab resistance is imparted by embedding chain mail in a polymer resin.

U.S. patent application Ser. No. 08/963,094, filed Nov. 3, 1997 (KB-4180-A), discloses an ice-pick-penetration-resistant composite with an outer face of tightly-woven yarn and an inner face of ballistic resistant material wherein the outer face must be the threat strike face.

SUMMARY OF THE INVENTION

This invention relates to a knife stab resistant ballistic article comprising an outer face that comprises a plurality of loosely woven knife stab resistant fabric layers and an inner face that comprises a plurality of ballistic layers.

DETAILED DESCRIPTION

The protective article of this invention was specifically developed to provide dual protection from penetration by knives and knife blades such as stilettos, kitchen knives, butterfly knives, boning knives, and the like, as well as protection from ballistic threats. It is becoming ever more important that police and security personnel have simultaneous protection from both knife stab threats and ballistic threats in the same protective garment. Such garments must be as flexible as possible to ensure sufficient comfort so that the garments will be readily worn. The inventor herein has investigated knife stab resistant articles and ballistic articles and has made startling discoveries relating to the combination of those articles.

Considerable effort has been expended in the past on improvement of protection from penetration by stabbing threats; and the assumption has been that improved stab resistance will be obtained from use of fabrics that are more tightly woven.

The inventor herein has found that assumption to be incorrect insofar as knife stabs are concerned. He has discovered that a woven fabric composite with a loose weave, quite surprisingly, exhibits improved resistance to penetration by knife stabs.

The inventor herein has discovered that the knife stab penetration resistance of a fabric composite is dramatically improved when yarns used to make the fabric of the article are woven to a tightness factor of less than 0.65. It is believed that a tightness factor as low as 0.20 will provide improved knife stab resistance. Up to the present invention, penetration resistant fabrics were tightly woven or impregnated by a matrix resin or both. In efforts completely opposite to the current technical understanding, the inventor herein, discovered that matrix-resin-free fabrics with a low fabric tightness factor exhibit improved knife stab penetration resistance. While any fabrics with any reduced tightness factor are expected to exhibit some improvement, the most improvement is found at a tightness factor of less than 0.65 and greater than 0.20. As the tightness factor is further reduced below 0.20, the fabric weave becomes so loose that an unacceptably high a real density would be required for effective protection.

Ballistic garments are generally made using several layers of protective fabric and the several layers are nearly always fastened together in a way to hold faces of the adjacent layers in fixed position relative to each other. It has been found that knife stab penetration resistance is improved if adjacent layers in a protective composite are not held together; but are free to move relative to each other. When adjacent layers are stitched closely together, knife stab penetration resistance is decreased.

The invention herein is constructed entirely of flexible woven fabric without rigid plates or platelets and without matrix resins impregnating the fabric materials. The articles of this invention are more flexible, lighter in weight, softer to the touch, more comfortable to be worn, and more pliable than penetration resistant constructions of the prior art offering comparable knife-stab protection.

Fabrics of the present invention are made, in whole or in part, from yarns having a tenacity of at least 10 grams per dtex and a tensile modulus of at least 150 grams per dtex. Such yarns can be made from aramids, polyolefins, polybenzoxazole, polybenzothiazole, and the like.

By "aramid" is meant a polyamide wherein at least 85% of the amide (—CO—NH—) linkages are attached directly to two aromatic rings. Suitable aramid fibers are described in Man-Made Fibers—Science and Technology, Volume 2, Section titled Fiber-Forming Aromatic Polyamides, page 297, W. Black et al., Interscience Publishers, 1968. Aramid fibers are, also, disclosed in U.S. Pat. Nos. 4,172,938; 3,869,429; 3,819,587; 3,673,143; 3,354,127; and 3,094,511.

Additives can be used with the aramid and it has been found that up to as much as 10 percent, by weight, of other polymeric material can be blended with the aramid or that copolymers can be used having as much as 10 percent of other diamine substituted for the diamine of the aramid or as much as 10 percent of other diacid chloride substituted for the diacid chloride of the aramid.

Para-aramids are the primary polymers in aramid yarn fibers of this invention and poly(p-phenylene terephthalamide) (PPD-T) is the preferred para-aramid. By PPD-T is meant the homopolymer resulting from mole-for-mole polymerization of p-phenylene diamine and terephthaloyl chloride and, also, copolymers resulting from incorporation of small amounts of other diamines with the p-phenylene diamine and of small amounts of other diacid chlorides with the terephthaloyl chloride. As a general rule, other diamines and other diacid chlorides can be used in amounts up to as much as about 10 mole percent of the p-phenylene diamine or the terephthaloyl chloride, or perhaps slightly higher, provided only that the other diamines and diacid chlorides have no reactive groups which interfere with the polymerization reaction. PPD-T, also, means copolymers resulting from incorporation of other aromatic diamines and other aromatic diacid chlorides such as, for example, 2,6-naphthaloyl chloride or chloro- or dichloroterephthaloyl chloride or 3,4'-diaminodiphenylether. Preparation of PPD-T is described in U.S. Pat. Nos. 3,869,429; 4,308,374; and 4,698,414.

By "polyolefin" is meant polyethylene or polypropylene. By polyethylene is meant a predominantly linear polyethylene material of preferably more than one million molecular weight that may contain minor amounts of chain branching or comonomers not exceeding 5 modifying units per 100 main chain carbon atoms, and that may also contain admixed therewith not more than about 50 weight percent of one or more polymeric additives such as alkene-1-polymers, in particular low density polyethylene, propylene, and the like, or low molecular weight additives such as anti-oxidants, lubricants, ultra-violet screening agents, colorants and the like which are commonly incorporated. Such is commonly known as extended chain polyethylene (ECPE). Similarly, polypropylene is a predominantly linear polypropylene material of preferably more than one million molecular weight. High molecular weight linear polyolefin fibers are commercially available. Preparation of polyolefin fibers is discussed in U.S. Pat. No. 4,457,985.

Polybenzoxazole and polybenzothiazole are preferably made up of mers of the following structures:

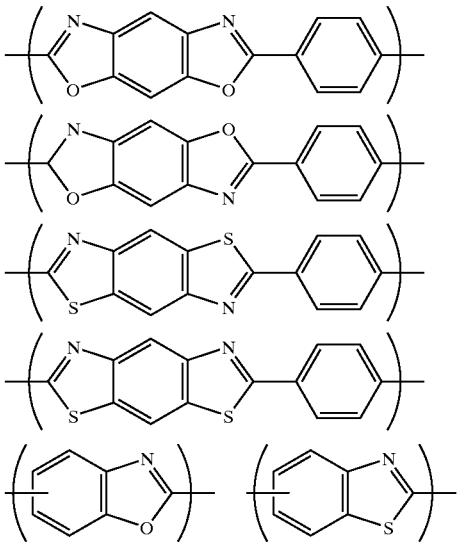

While the aromatic groups shown joined to the nitrogen atoms may be heterocyclic, they are preferably carbocyclic; and while they may be fused or unfused polycyclic systems, they are preferably single six-membered rings. While the group shown in the main chain of the bis-azoles is the preferred para-phenylene group, that group may be replaced by any divalent organic group which doesn't interfere with preparation of the polymer, or no group at all. For example, that group may be aliphatic up to twelve carbon atoms, tolylene, biphenylene, bis-phenylene ether, and the like.

The polybenzoxazole and polybenzothiazole used to make fibers of this invention should have at least 25 and preferably at least 100 mer units. Preparation of the polymers and spinning of those polymers is disclosed in International Publication WO 93/20400.

"Fabric tightness factor" and "Cover factor" are names given to the density of the weave of a fabric. Cover factor is a calculated value relating to the geometry of the weave and indicating the percentage of the gross surface area of a fabric which is covered by yarns of the fabric. The equation used to calculate cover factor is as follows (from Weaving: Conversion of Yarns to Fabric, Lord and Mohamed, published by Merrow (1982), pages 141–143):

$d_w$=width of warp yarn in the fabric $d_f$=width of fill yarn in the fabric $p_w$=pitch of warp yarns (ends per unit length)

$p_f$=pitch of fill yarns $$C_w = \frac{d_w}{p_w} \qquad C_f = \frac{d_f}{p_f}$$

$$\text{Fabric Cover Factor} = C_{fab} = \frac{\text{total area obscured}}{\text{area enclosed}}$$

$$C_{fab} = \frac{(p_w - d_w)d_f + d_w p_f}{p_w p_f} = (C_f + C_w - C_f C_w)$$

Depending on the kind of weave of a fabric, the maximum cover factor may be quite low even though the yarns of the fabric are situated close together. For that reason, a more useful indicator of weave tightness is called the "fabric tightness factor". The fabric tightness factor is a measure of the tightness of a fabric weave compared with the maximum weave tightness as a function of the cover factor.

$$\text{Fabric tightness factor} = \frac{\text{actual cover factor}}{\text{maximum cover factor}}$$

For example, the maximum cover factor that is possible for a plain weave fabric is 0.75; and a plain weave fabric with an actual cover factor of 0.68 will, therefore, have a fabric tightness factor of 0.91.

As a general rule, flexible ballistic articles are made using layers of fabric made from yarn material with high tenacity and toughness in enough layers to be effective against a specified threat. Fabrics for ballistic protection generally use yarns with relatively high linear densities and, when woven, have little regard for tightness of weave, except to avoid extremely tight weaves to avoid damage of yarn fibers resulting from the rigors of weaving.

The particular combination of this invention, utilizing knife stab resistant material and ballistic material, exhibits a good ballistic protection and a knife stab resistance which is much greater than would be expected from the sum of the knife stab resistance of the individual elements of the combination. The individual elements of the combination of this invention include an outer face and an inner face.

The outer face includes a plurality of relatively loosely woven fabric layers made from yarns of high strength fibers wherein the yarns generally have a tenacity of at least 10 grams per dtex (11.1 grams per denier). While there is no upper limit for the tenacity, below a tenacity of about 5 grams per dtex, the yarn doesn't exhibit adequate strength for meaningful protection. The yarns used herein must have a tensile modulus of at least 150 g/dtex because too low a modulus will result in excessive fiber stretching and ineffective restriction of the movement of the bullet or stabbing knife. There is no upper limit for the tensile modulus. Individual filaments in these yarns have a linear density of 0.2 to 8 dtex and preferably 0.7 to 2.5 dtex. The layers of the outer face can be made from aramids, polyolefins, polybenzoxazoles, polybenzothiazoles, or other polymers.

The preferred material for layers of the outer face is para-aramid yarns. For the outer face fabric, any of the usually-used weaves can be used including plain, crowfoot, basket, satin, twill, and the like. The preferred weaves for the knife stab resistant material of this invention are twill and satin weaves and their variants, including crowfoot weave—sometimes known as 4-harness satin weave, since they are more flexible and pliable than plain weave and can better conform to complex curves and surfaces. The preferred linear density for yarns in the outer face is 100 to 4000 dtex and those yarns are preferably woven to a fabric tightness factor of 0.2 to 0.65.

While the reason for the improved knife stab protection of this invention is not well understood, it is believed to relate to absorption of energy from a knife blade as yarns in a loosely-woven fabric are moved but not cut by contact with a stabbing blade.

A single layer of the woven article of the stab resistant material of this invention would provide a measure of knife stab penetration resistance and, therefore, a degree of protection; but a plurality of layers is required in an ultimate product. It is in the use of a plurality of low tightness factor fabric layers with a total a real density of at least 1 kg/m$^2$ that the present invention exhibits its most pronounced and surprising improvement. It has been discovered that articles of this invention, when placed together in a plurality of layers, afford a surprisingly effective penetration resistance when the articles are not affixed to one another, thereby permitting relative movement between adjacent layers. The construction of the protective structure of this invention may also include a plurality of layers of the aforementioned woven fabric and a felt material, generally made from aramid staple fibers. The felt can be of a density from 200 to 4000 grams per square meter, preferably from 500 to 1000 grams per square meter. Adjacent layers or articles may be fastened at the edges or there may be some loose interlayer connections at relatively great spacings compared with the thickness of the articles. For instance, layer-to-layer attachments at point spacings of greater than about 15 centimeters would serve, for this application, as being substantially free from means for holding the layers together. Layers which have been stitched together over the surface of the layers may provide more effective ballistics protection; but such stitching causes immobility between the layers and, for reasons not entirely understood, actually decreases the knife stab penetration resistance of the layers as compared with expectations based on single layer tests.

While various standards have been developed and used globally, in general, standards for knife stab protection mandate a knife stab penetration resistance of greater than 20 joules. The composite of the present invention performs at that level at a relatively low a real density. Also, as a result of the low tightness factor, the composite is flexible and breathable and can conform to the shape of the body for comfort as an effective protective garment component. Knife stab protection is, of course, improved as the areal density of the composite is increased; but the inventor estimates that little practical benefit is achieved at areal densities above about 20 kg/m$^2$ due to the increased bulkiness and reduced comfort of the protective garment.

The inner face includes a plurality of layers of fibrous material which provide ballistic protection. The layers of the inner face can be woven or non-woven, and, if non-woven, can be unidirectional, uni-weave, or the like. The layers can be made from aramids, polyolefins, polybenzoxazoles, polybenzothiazoles, or other polymers usually used for ballistic protection. The preferred construction for layers of this inner face is woven para-aramid yarns with a linear density of 100 to 4000 dtex. If woven, plain weave is preferred to a fabric tightness factor of greater than about 0.90, although other weave types, such as basket weave, satin weave, or twill weave, can be used. The preferred para-aramid is poly(p-phenylene terephthalamide).

Yarns used in the fabrics of this invention, for outer faces and for inner faces, should exhibit a tenacity of greater than 10 grams per dtex and as much as 50 grams per dtex or more; an elongation to break of at least 2% and as much as 6% or more; and a modulus of at least 150 grams per dtex and as much as 2000 grams per dtex or more.

A combination of an outer face and an inner face is made by placing the two together, in face to face relation, with other layer materials therebetween or not, as desired. Other layer materials which may be placed between the outer and inner faces include, for example, cushioning materials, adhesive materials, water proofing materials, and the like.

It has been discovered that a combination of an outer face and an inner face, in accordance with the present invention, produces a knife stab resistance that is much greater than the sum of the knife stab resistances that would be exhibited by the outer and inner faces taken individually. Quite remarkably, it has also been discovered that a combination of an outer face with an inner face in a manner outside the present invention provides a knife stab resistance that is much lower than the sum of the knife stab resistances of the individual faces.

To be specific, and as will be shown in the Example, in a combination of an outer face with an inner face wherein the inner face is used as the strike face for a stabbing threat, the knife stab resistance is much less than the sum of the knife stab resistances for the individual faces taken alone. For that same combination, when the outer face is used as the strike face for a stabbing threat, the knife stab resistance is much greater than the sum of the knife stab resistances for the individual faces taken alone.

The gist of this invention resides in the discovery that a combination of different layer materials, when configured in one way, yields unexpectedly poor results and, when configured in another way, yields unexpectedly good results. The outer face of the combination of this invention is the face with the greatest knife stab resistance and, for the purposes of this invention, must be the face that is to be struck by the knife stab threat.

Test Methods

Linear Density. The linear density of a yarn is determined by weighing a known length of the yarn. The term "dtex" is defined as the weight, in grams, of 10,000 meters of the yarn.

In actual practice, the measured dtex of a yarn sample, test conditions, and sample identification are fed into a computer before the start of a test; the computer records the load-elongation curve of the yarn as it is broken and then calculates the properties.

Tensile Properties. Yarns tested for tensile properties are, first, conditioned and, then, twisted to a twist multiplier of 1.1. The twist multiplier (TM) of a yarn is defined as:

$$TM=(\text{twists/cm})(d\text{tex})^{1/2}/30.3$$

The yarns to be tested are conditioned at 25° C., 55% relative humidity for a minimum of 14 hours and the tensile tests are conducted at those conditions. Tenacity (breaking tenacity), elongation to break, and modulus are determined by breaking test yarns on an Instron tester (Instron Engineering Corp., Canton, Mass.).

Tenacity, elongation, and initial modulus, as defined in ASTM D2101-1985, are determined using yarn gage lengths of 25.4 cm and an elongation rate of 50% strain/minute. The modulus is calculated from the slope of the stress-strain curve at 1%. strain and is equal to the stress in grams at 1% strain (absolute) times 100, divided by the test yarn linear density.

Toughness. Using the stress-strain curve from the tensile testing, toughness is determined as the area (A) under the stress/strain curve up to the point of yarn break. It is usually determined employing a planimeter, to provide area in square centimeters. Dtex (D) is as described above under "Linear Density". Toughness (To) is calculated as $$To = A \times (FSL/CFS)(CHS/CS)(1/D)(1/GL)$$

where

FSL=full-scale load in grams

CFS=chart full scale in centimeters

CHS=crosshead speed in cm/min

CS=chart speed in cm/min

GL=gauge length of test specimen in centimeters

Digitized stress/strain data may, of course, be fed to a computer for calculating toughness directly. The result is To in dN/tex. Multiplication by 1.111 converts to g/denier. When units of length are the same throughout, the above equation computes To in units determined only by those chosen for force (FSL) and D.

Penetration Resistance. Knife stab penetration resistance is determined on a plurality of layers of the fabrics using a PSDB P1 single-edge blade with a Rockwell hardness of 52–55 and with a total length of 10 cm and thickness of 2 mm as specified in the "PSDB Stab Resistance Standard for Body Armor", issued in 1999 by the Police Scientific Development Branch of the United Kingdom. Tests are conducted in accordance with HPW drop test TP-0400.03 (Nov. 28, 1994) from H. P. White Lab., Inc., except that PSDB P1 blades are used, and a composite material of four layers of 6 mm neoprene, one layer of 30 mm Plastazote foam, and two layers of 6 mm rubber was used as the backing material, in accordance with the aforementioned PSDB Stab Resistance Standard. Test samples, placed on the backing material, are impacted with the PSDB P1 knife that has been weighted to 4.54 kilograms (10 pounds) and dropped from various heights until penetration of less than 7 mm through the sample under test is accomplished. Results are reported as penetration energy (joules) by multiplying kilogram-meters, from the energy at the penetrating height, by 9.81.

Ballistics Performance. Ballistic tests of the multi-layer panels are conducted to determine the ballistic limit (V50) in accordance with MIL-STD-662e, except in the use of Roma Plastilina No. 1 modeling clay for the backing material and the selection of projectiles, as follows: A panel to be tested is placed in a sample mount to hold the panel taut and perpendicular to the path of test projectiles. The projectiles are 9 mm full metal jacket hand-gun bullets weighing 124 grains, and are propelled from a test barrel capable of firing the projectiles at different velocities. The first firing for each panel is for a projectile velocity estimated to be the likely ballistics limit (V50). When the first firing yields a complete panel penetration, the next firing is for a projectile velocity of about 15.5 meters (50 feet) per second less in order to obtain a partial penetration of the panel. On the other hand, when the first firing yields no penetration or partial penetration, the next firing is for a velocity of about 15.2 meters (50 feet) per second more in order to obtain a complete penetration. After obtaining one partial and one complete projectile penetration, subsequent velocity increases or decreases of about 15.2 meters (50 feet) per second are used until enough firings are made to determine the ballistics limit (V50) for that panel.

The ballistics limit (V50) is calculated by finding the arithmetic mean of an equal number of at least three of the highest partial penetration impact velocities and the lowest complete penetration impact velocities, provided that there is a difference of not more than 38.1 meters (125 feet) per second between the highest and lowest individual impact velocities.

EXAMPLE 1

Tests for this example were conducted using layers of woven aramid yarn. The yarn was aramid yarn sold by E. I. du Pont de Nemours and Company under the trademark, Kevlar®. The aramid was poly(p-phenylene terephthalamide).

The outer face was made using twenty four (24) layers of fabric woven from 1266 dtex aramid yarn with a tenacity of 21.3 grams per dtex, a modulus of 790 grams per dtex, and elongation at break of 2.5%, in a crowfoot weave at 7×7 ends per centimeter and a fabric tightness factor of 0.56. The outer face had an areal density of 4.34 kg/m$^2$.

The inner face was made using twenty two (22) layers of fabric woven from 930 dtex aramid yarn with a tenacity of 24.0 grams per dtex, a modulus of 675 grams per dtex, and an elongation at break of 3.4%, in a plain weave at 12.2×12.2 ends per centimeter and a fabric tightness factor of 0.925. The inner face had an areal density of 5.08 kg/m$^2$.

The outer and inner faces were tested individually and in combination for knife stab resistance and ballistic limit. The combination was made by placing the outer face and the inner face together. Results of the tests are shown in the table.

| Faces | No. of Layers | Min. Penetrating Kinetic Energy (joules) | Ballistic Limits V50 (m/sec) |
|---|---|---|---|
| Outer face only | 24 | 20.3 | 423 |
| Inner face only | 22 | <5 | 466 |
| Inner face over Outer face | 22/24 | 13.6 | 591 |
| Outer face over Inner face | 24/22 | 50.9 | 573 |

Minimum penetrating kinetic energy is the test result, in joules, for the Knife Stab Resistance Test described in the Test Methods. Note that the outer face exhibited a respectable minimum penetrating energy of 20 joules and the inner face exhibited very little knife stab resistance. When the inner and outer faces were combined for testing with the inner face as the strike face, the minimum penetrating kinetic energy was less than that of the outer face tested alone.

When the inner and outer faces were combined for testing with the outer face as the strike face (in accordance with this invention), the minimum penetrating kinetic energy was surprisingly high and was even more than twice as high as the sum of the two faces tested alone. The article of this invention also exhibited good ballistic protection at a V50 of 573 m/sec.

What is claimed is:

1. A knife stab resistant ballistic article comprising an outer face which comprises a plurality of loosely-woven knife stab resistant fabric layers woven to a fabric tightness factor of less than 0.65 and an inner face that comprises a plurality of ballistic layers wherein the outer face is the face of the article which is the strike face for knife stab threats.

2. The article of claim 1 wherein the knife stab resistant layers comprise fabric woven from aramid yarn and characterized by having the fabric woven to a fabric tightness factor of 0.2 to 0.65.

3. The article of claim 2 wherein the aramid yarn is para-aramid yarn.

4. The article of claim 2 wherein the yarn has a linear density of 100 to 4000 dtex.

5. The article of claim 2 wherein the fabric layers are made from fibers exhibiting elongation to break of greater than 2%, a modulus of greater than 150 grams per dtex, and tenacity greater than 10 grams per dtex.

6. The article of claim 1 wherein the fabric layers are made from fibers exhibiting elongation to break of greater than 2%, a modulus of greater than 150 grams per dtex, and tenacity greater than 10 grams per dtex.

7. The article of claim 1 wherein the yarns of the ballistic layers are woven.

8. The article of claim 1 wherein the yarns of the ballistic layers are non-woven.

9. The article of claim 1 wherein the yarns of the ballistic layers are para-aramid.

* * * * *